United States Patent [19]

Berger

[11] Patent Number: 4,558,827

[45] Date of Patent: Dec. 17, 1985

[54] APPARATUS FOR SHREDDING DOCUMENTS

[75] Inventor: Zoltan Berger, Ueberlingen, Fed. Rep. of Germany

[73] Assignee: Borbe-Wanner AG., Switzerland

[21] Appl. No.: 479,722

[22] Filed: Mar. 28, 1983

[30] Foreign Application Priority Data

Mar. 30, 1982 [CH] Switzerland ..... 1950/82

[51] Int. Cl.[4] ..... B02C 18/16

[52] U.S. Cl. ..... 241/224; 241/243; 241/295

[58] Field of Search ..... 241/101.7, 222, 223, 241/224, 239, 240, 241, 242, 243, 100, 57, 60, 61, 293, 294, 166, 167, 236, 295, 190

[56] References Cited

U.S. PATENT DOCUMENTS

| | | | |
|---|---|---|---|
| 2,297,782 | 10/1942 | Krider | 241/293 X |
| 2,335,515 | 11/1943 | Jehle | 241/295 X |
| 2,655,213 | 10/1953 | Anderson | 241/295 X |
| 2,669,271 | 2/1954 | Treckmann | 241/101.7 X |
| 4,200,239 | 4/1980 | Simone et al. | 241/243 |
| 4,355,766 | 10/1982 | Wigand | 241/243 X |
| 4,394,983 | 7/1983 | Ulsky | 241/243 |

FOREIGN PATENT DOCUMENTS

| | | | |
|---|---|---|---|
| 343780 | 2/1960 | Switzerland | 241/243 |
| 1342354 | 1/1974 | United Kingdom | 241/236 |

*Primary Examiner*—Mark Rosenbaum

*Attorney, Agent, or Firm*—Roylance, Abrams, Berdo & Goodman

[57] ABSTRACT

A document shredder having a rotary cutter with axially extending rows of teeth, each row having alternating teeth of different heights. The heights of the teeth are selected such that the difference in the heights of the teeth is greater than the height of the smaller teeth. This relationship ensures breaking up of the document into small shreds and allows the cutter to be driven at low speeds, thereby reducing the power requirements and the noise level.

20 Claims, 3 Drawing Figures

APPARATUS FOR SHREDDING DOCUMENTS

This invention relates to an apparatus for shredding documents and, more specifically, to an apparatus of the type having a rotary cutter with at least one row of teeth wherein the teeth have different heights, the apparatus also including a fixedly supported serrated member having a profile conforming to the teeth and being adjacent the cutter.

BACKGROUND OF THE INVENTION

It is well known at the present time to provide an apparatus capable of shredding documents which can be of various types including foil, sheet and strip material. The material can also differ and can be, for example, paper, plastic or the like. At the present time, one important type of document to be shredded consists of plastic strips and tapes of various kinds including magnetic tapes, microfilm strips, and other similar articles.

Large quantities of the aforementioned documentary materials are obtained at different places and, for various reasons, must be destroyed. These reasons include the maintenance of secrecy but also include the fact that the material has become superceded or out of date. However, it is necessary for destruction to take place in such a way that the "destroyed" documents would not yield any useful information if they fell into unauthorized hands.

A particularly reliable way of insuring that no information can be gathered from the documentary material consists of making it unusable by shredding it into very small pieces. For this purpose, various structures have been devised which shred the documents into more or less small shreds. In one known structure, shown in U.S. Pat. No. 4,200,239, a high-speed rotor is used which is equipped with one or two rows of teeth which cooperate with a fixed serrated member. In order to achieve good shredding action, the teeth of each row are constructed at different heights in an alternating manner. The serrated member is also formed in a scalloped manner to conform with the tooth sequence. In order to achieve uniform shredding of the documents, a delivery support is provided on which is arranged a feed roller. The function of the feed roller is to uniformly move the sheet, strip or other documentary material against the rotating teeth of the rotor. However, if the feed is not correctly set with respect to the rotor speed in this known structure, clean separation of the documents into individual portions does not result. The reason for this is that the feed of the documents per tooth row is greater than the radial spacing between the tips of the teeth of the larger and smaller teeth in each row. If this occurs, the unequally long teeth are no longer able to separate individual shreds from the supply document and, instead, cut a scalloped strip which is continuous over the axial length of the rotatable cutter. This is an undesirable result because it no longer guarantees the destruction of the information on the documents.

Thus, in this known structure, it is necessary to check the feed and ensure that it correctly functions in such a way that there are no continuous shreds in the axial direction of the rotor. This makes the apparatus more complicated because a feed device must be provided in each machine.

BRIEF SUMMARY OF THE INVENTION

Accordingly, an object of the present invention is to provide a shredding apparatus which is constructed such that the formation of continuous shred strips is reliably avoided, even if there is no feed device to maintain a particular feed rate.

Briefly described, the invention includes an improved document shredding apparatus of the type having a rotary cutter with a generally cylindrical body and radially extending cutting teeth of different heights protruding from the body and a fixedly mounted serrated member adjacent the cutter, the serrations thereof being profiled to conform to the lengths of the teeth. In this apparatus, the cutting teeth on the rotary cutter include at least one axially extending row of teeth wherein the teeth have two different heights, the shorter ones of the teeth having a height which is equal to or less than the difference between the heights of the shorter and taller teeth.

Further, the invention includes such an apparatus wherein the cutter has a plurality of rows of teeth distributed over the circumference of the cutter body, the height relationship between the teeth of each row being the same.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification and wherein.

DETAILED DESCRIPTION

Figure 1:
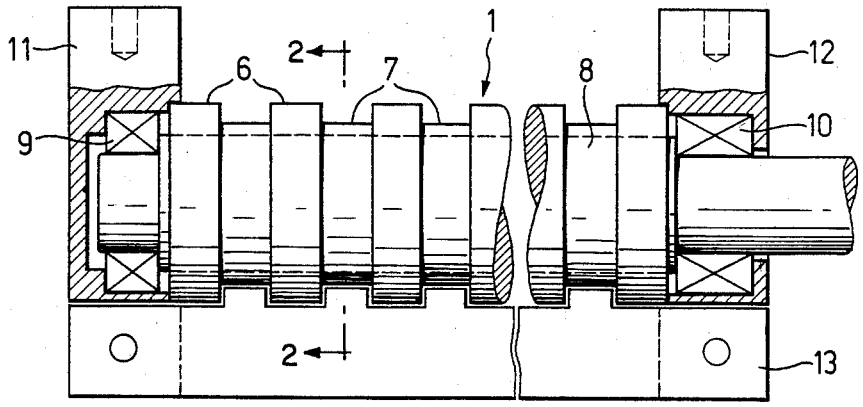
FIG. 1 is a schematic front elevation of a rotary cutter in accordance with the invention in conjunction with a fixed serrated member.
Figure 2:
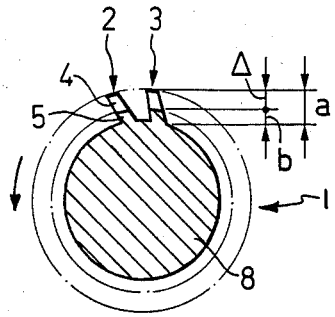
FIG. 2 is a partly schematic transverse sectional view along line 2—2 of FIG. 1.

FIGS. 1 and 2 show a rotary cutter of the type with which the invention is concerned, but the cutter shown therein is schematically represented because the very small height of the teeth, relative to the diameter of the overall cutter, makes exact representation thereof extremely difficult. However, there will be no difficulty in understanding the principles from these schematic illustrations.

Viewing FIGS. 1 and 2 together, it will be seen that the rotary cutter indicated generally at 1 includes a plurality of axially extending rows of teeth occupying substantially the entire width of the cutter, FIG. 2 showing two rows 2 and 3 in an enlarged, exaggerated form. Each of rows 2 and 3 includes a succession of teeth in which larger teeth 4 alternate with smaller teeth 5. In the embodiment shown, the teeth are mounted on a generally cylindrical cutter body 8 so that substantially the entire outer periphery of body 8 is covered with the radially protruding teeth. Thus, as viewed in the aggregate, the circular arrangement of larger teeth 4 of all of the rows 2, 3 form annular projecting portions 6 on the cutter while the smaller teeth 5 of all of the rows form recessed annular portions 7. As seen in FIG. 2, the radial height of each of the larger teeth is identified as a and that of the smaller teeth 5 is identified as b.

However, in reality, the smaller teeth 5 are not recognizable as isolated teeth and, instead, form a cutting edge in the spacing b from the circumference of roller body 8 between, in each case, two larger teeth 4. The essential point is that the difference $$\Delta = a - b > b.$$

This equation means that the difference in the height between the larger and smaller teeth 4, 5 must be greater than the height of each smaller tooth 5. If this condition is satisfied on cutter 1 the undesired case of the formation of long strips or shreds does not occur, even if the feed is not set correctly or is not functioning correctly. This condition can also be described as a ratio between the heights of the two teeth 4, 5 which must be at least 2.0. Preferred values for this ratio are between about 2.1 and about 3.5.

Cutting roller 1 is supported at its ends in roller bearings 9 and 10 which are supported in bearing blocks 11 and 12. Blocks 11, 12 are interconnected by a serrated member 13 which is profiled so as to conform with the alternating projecting and recessed portions 6, 7 formed by the teeth on the cutter. Preferably, the serrated member is arranged so that the spacing between the profile edge and the cutter periphery can be adjusted.

As FIGS. 1 and 2 are not dimensionally accurate, it should be pointed out that the height of each of the larger teeth is less than one millimeter. Correspondingly, the difference Δ is a few tenths of a millimeter. By employing the arrangement and selection of the relative dimensions of teeth 4 and 5 and the arrangement of a plurality of rows of teeth which can be, for example, at least 40, the speed of the rotating cutter 1 can be made relatively low, for example, below 250 rpm and, preferably, below 150 rpm. Because of this lower speed, the drive power for the rotatable cutter is low and can be, in fact, less than 100–200 watts. Nevertheless, the efficiency of a cutter constructed as described is very high and is comparable with that of known constructions which, however, require a power input greater by at least a power of 10.

Figure 3:
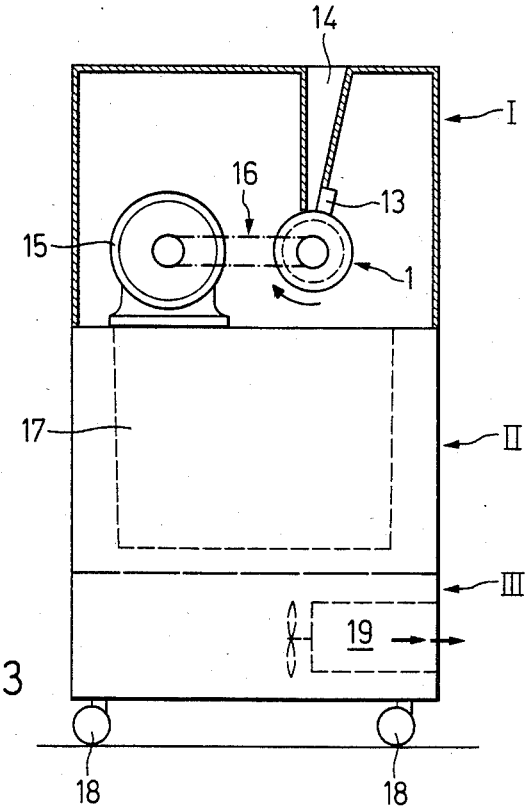
FIG. 3 is a schematic side elevation, partly in section, of a document shredding machine incorporating a cutter structure of the type shown in FIGS. 1 and 2.

FIG. 3 diagrammatically shows a document shredding machine equipped with a cutter 1 of the type shown in FIGS. 1 and 2. The machine essentially comprises three major portions identified in the figure as a shredding portion I, a collecting portion II and a ventilating portion III.

The shredding portion 1, which is partially shown in section, has a rotatable cutter 1 which is disposed at the lower end of a generally vertically directed delivery gap or chute 14 through which the documents are introduced. In the embodiment shown, the documents are advanced under their own weight. Despite the lack of a feed or advance mechanism, completely satisfactory shredding of the material is achieved because the teeth 4, 5 arranged on the body of the rotatable cutter have the heights in accordance with the invention. The serrated member 13 in the embodiment of FIG. 3 is mounted at the lower end of one of the walls defining the delivery chute 14. The rotatable cutter is rotatably driven by a drive motor 15 which can be, for example, a geared motor coupled to the cutter by a drive such as a tooth belt drive. The shredded material is collected in a sack or bag 17 arranged in collecting part II. A fan provided in ventilating part III produces a suction flow by means of which the shredded documents are reliably introduced into bag 17.

The machine can be equipped with casters 18 so that it can be used at different locations. It is obviously possible to arrange portions I, II and III of the machine in some other way, e.g., horizontally. It is also possible to provide a feed or advance mechanism in gap 14, particularly if the gap or chute has a shallow slope or is horizontal instead of being substantially vertical. However, the essential point is for the cutter 1 to be constructed in the described way in order to fully utilize the advantages of such a machine, i.e., low power requirements, low cutter speed and correspondingly low noise levels but with reliable shredding of the documents into very shreds.

Cutter 1 can appropriately be made from a single hardened piece of material. The walls of the machine shown in FIG. 3 can appropriately be made from a light metal or plastic.

The theoretically smallest value for the tooth height ratio a/b of 2.0, to enable the shred width to be equal to the tooth width must, in practice, be chosen somewhat larger as a function of the document to be processed so that no width-continuous shred material is obtained. However, it is important that the greatest advance of the documentary material per row of teeth be limited by the circumference of the roller body 8 and can consequently never be larger than the height b of the smallest tooth 5.

While certain advantageous embodiments have been chosen to illustrate the invention, it will be understood by those skilled in the art that various modifications and changes can be made therein without departing from the scope of the invention as defined in the appended claims.

What is claimed is:

1. An apparatus for shredding documents, comprising:

a rotary cutter having a generally cylindrical body and a plurality of cutting teeth of different heights extending radially from said body, said cutting teeth being arranged in a plurality of discrete axially extending, parallel and straight rows of alternating relatively taller cutting teeth and relatively shorter cutting teeth within each row each of said taller teeth having a first radial height, each of said shorter teeth having a second radial height, said first and second heights being defined by $$b \leqq a - b,$$

wherein a = said first height and b = said second height; and a serrated member fixedly mounted adjacent said rotary cutter and having a profiled edge providing serrations conforming to and mating with said shorter and taller cutting teeth.

2. An apparatus according to claim 1 wherein a document feed means is mounted adjacent said rotary cutter for feeding documents to said rotary cutter; and said rotary cutter is coupled to said drive means, said drive means operating independently of said document feed means.

3. An apparatus according to claim 2 wherein said document feed means feed documents by gravity.

4. An apparatus according to claim 1 wherein said plurality of rows of cutting teeth are distributed about a circumference of said body; and (a−b) is the same for each of said rows.

5. An apparatus according to claim 4 wherein $a/b \geqq 2.0.$

6. An apparatus according to claim 5 wherein a/b is between about 2.1 and 3.3.

7. An apparatus according to claim 1 wherein $a/b \geqq 2.0.$

8. An apparatus according to claim 1 wherein each of said cutting teeth has an axially extending cutting edge.

9. An apparatus according to claim 1 wherein said cutter includes at least 40 rows of teeth uniformly distributed over said body.

10. An apparatus according to claim 1 wherein said cutter includes at least 60 rows of teeth uniformly distributed around said body.

11. An apparatus according to claim 1 and including means for rotatably driving said cutter at a speed of less than 250 rpm.

12. An apparatus according to claim 1 and including means for rotatably driving said cutter at a speed of less than 150 rpm.

13. An apparatus according to claim 1 and further comprising a housing enclosing said cutter;

means attached to said housing defining a generally vertically directed delivery chute having guide walls.

14. An apparatus according to claim 1 wherein the front face of each tooth slopes forwardly in the direction of rotation.

15. An apparatus for shredding documents, comprising:

a rotary cutter having a generally cylindrical body and a plurality of cutting teeth of different heights extending radially from said body, said cutting teeth being arranged in a plurality of discrete axially extending, parallel and straight rows of alternating relatively taller cutting teeth and relatively shorter cutting teeth, each of said taller teeth having a first radial height, each of said shorter teeth having a second radial height, said first and second heights being defined by $b \leqq a-b$ and a/b is between about 2.1 and 3.3 wherein a=said first height and b=said second height; and a serrated member fixedly mounted adjacent said rotary cutter and having a profiled edge providing serrations conforming to and mating with said shorter and taller cutting teeth.

16. An apparatus according to claim 15 wherein a document feed means is mounted adjacent said rotary cutter for feeding documents to said rotary cutter; and said rotary cutter is coupled to said drive means, said drive means operating independently of said document feed means.

17. An apparatus according to claim 16 wherein said document feed means feed documents by gravity.

18. An apparatus for shredding documents, comprising:

a rotary cutter having a generally cylindrical body and a plurality of cutting teeth of different heights extending radially from said body, said cutting teeth being arranged in a plurality of discrete axially extending, parallel and straight rows of alternating relatively taller cutting teeth and relatively shorter cutting teeth, each of said taller teeth having a first radial height less than 1.0 mm, each of said shorter teeth having a second radial height, said first and second heights being defined by $b \leqq a-b$ wherein a=said first height and b=said second height; and a serrated member fixedly mounted adjacent said rotary cutter and having a profiled edge providing serrations conforming to and mating with said shorter and taller cutting teeth.

19. An apparatus according to claim 18 wherein a document feed means is mounted adjacent said rotary cutter for feeding documents to said rotary cutter; and said rotary cutter is coupled to said drive means, said drive means operating independently of said document feed means.

20. An apparatus according to claim 19 wherein said document feed means feed documents by gravity.

* * * * *